US012338025B2

(12) United States Patent
Wieland et al.

(10) Patent No.: US 12,338,025 B2
(45) Date of Patent: Jun. 24, 2025

(54) APPARATUS AND METHOD FOR STRAIGHTENING A PACKAGE

(71) Applicant: OPTIMA pharma GmbH, Schwäbisch Hall (DE)

(72) Inventors: Werner Wieland, Frankenhardt (DE); Bernd Laukenmann, Crailsheim (DE)

(73) Assignee: OPTIMA pharma GmbH, Schwäbisch Hall (DE)

( * ) Notice: Subject to any disclaimer, the term of this patent is extended or adjusted under 35 U.S.C. 154(b) by 3 days.

(21) Appl. No.: 18/723,437

(22) PCT Filed: Feb. 21, 2023

(86) PCT No.: PCT/EP2023/054268
§ 371 (c)(1),
(2) Date: Jun. 23, 2024

(87) PCT Pub. No.: WO2023/161208
PCT Pub. Date: Aug. 31, 2023

(65) Prior Publication Data

US 2024/0417126 A1 Dec. 19, 2024

(30) Foreign Application Priority Data

Feb. 25, 2022 (DE) ..... 102022201965.2

(51) Int. Cl.
*B65B 31/00* (2006.01)
*B65B 69/00* (2006.01)

(52) U.S. Cl.
CPC ..... *B65B 69/0041* (2013.01); *B65B 31/00* (2013.01)

(58) Field of Classification Search
USPC ..... 53/385.1
See application file for complete search history.

(56) References Cited

U.S. PATENT DOCUMENTS 6,244,023 B1 6/2001 Lataix
8,813,464 B2 8/2014 Leidig
2016/0176598 A1* 6/2016 Palumbo ..... B65B 31/00 53/427
2017/0152069 A1 6/2017 Makiranta
(Continued)

FOREIGN PATENT DOCUMENTS

DE 39 21 356 A1 1/1991
DE 3921356 A * 1/1991 ..... B65B 69/0047
DE 10 2011 080 289 A1 2/2013
(Continued)

OTHER PUBLICATIONS

Written Opinion of the International Searching Authority issued Jun. 23, 2023 in connection with PCT/EP2023/054268.
(Continued)

*Primary Examiner* — Chinyere J Rushing-Tucker
(74) *Attorney, Agent, or Firm* — Akerman LLP

(57) ABSTRACT

The invention relates to an apparatus and a method for straightening a foil bag (2) with a sterile object (20) packaged therein, wherein the foil bag (2) is pierced by means of a hollow needle (40), gas is injected into the foil bag (2), and a detaching force is applied to the foil bag (2) before piercing into the foil bag (2), with the result that the foil bag (2) is detached from the sterile object (20) packaged therein at least in a region which lies opposite the hollow needle (40).

15 Claims, 6 Drawing Sheets

(56) References Cited

U.S. PATENT DOCUMENTS

2020/0172280 A1 6/2020 Franke et al.

FOREIGN PATENT DOCUMENTS

| | | | | |
|---|---|---|---|---|
| DE | 102016100711 | A1 * | 7/2017 | ..... B01F 9/0016 |
| GB | 1097859 | A | 1/1968 | |
| GB | 2236517 | A | 4/1991 | |

OTHER PUBLICATIONS

International Search Report issued Jun. 23, 2023 in connection with PCT/EP2023/054268.
Communication regarding Third Party Observations filed Feb. 4, 2025 in connection with European Patent Application No. 20230706590.

* cited by examiner

APPARATUS AND METHOD FOR STRAIGHTENING A PACKAGE

CROSS-REFERENCE TO RELATED APPLICATIONS

This application is a national phase of PCT/EP2023/054268, filed Feb. 21, 2023, and claims priority to DE 102022201965.2, filed Feb. 25, 2022, the entire contents of both of which are hereby incorporated by reference.

FIELD OF APPLICATION AND PRIOR ART

The invention relates to an apparatus and a method for straightening a foil bag with a sterile object packaged therein.

For pharmaceutical and/or cosmetic applications, it is known for syringes, cartridges, vials, or other vessels to be provided in tubs. In order to satisfy high sterility requirements, it is known to seal the tubs and in addition to pack the sealed tubs in foil bags.

Accordingly, bag unpacking systems are to be provided in an automated filling plant, by means of which bag unpacking systems the tubs are removed from the foil bags.

For non-sterile applications, DE3921356 A1 discloses, for example, piercing a packaging foil by means of a hollow needle before cutting through the packaging foil for simplified removal of the packaging foil from a polyester compound, and injecting compressed air into this packaging foil by means of the hollow needle. Here, a tip of the hollow needle penetrates into the polyester compound.

Problem and Solution

It is an object of the invention to provide an apparatus and a method for straightening a foil bag with a sterile object packaged therein, which apparatus and method satisfy the high requirements of process reliability for pharmaceutical and/or cosmetic applications.

This object is solved by the apparatus and the method with the features of claims 1 and 8. Further embodiments are defined in the dependent claims.

In accordance with a first aspect, an apparatus for straightening a foil bag with a sterile object packaged therein is provided, comprising a needle unit with a hollow needle for piercing the foil bag and with a gas port for injecting gas via the hollow needle into the foil bag, wherein a detaching device is provided which is configured to apply a detaching force to the foil bag before a piercing operation, with the result that the foil bag is detached from the sterile object packaged therein at least in a region which lies opposite the hollow needle.

In conjunction with the application, the terms "a", "an", etc. are used merely as an indefinite article and not as numerical values. The terms "first", "second", etc. likewise serve merely to differentiate elements or assemblies and do not indicate any order. The use of the term "first", etc. does not mandate presence of second or further elements or assemblies.

In conjunction with the application, a movement of the foil bag relative to the object packaged therein is referred to as "straightening of a foil bag", wherein, in particular, folded-in or folded-away parts of the foil bag (also called tabs) which bear against a wall of the object without being fixed on another section of the foil bag are unfolded, folded out and/or tautened.

A region of the foil bag about a piercing location to be made in the foil bag is referred to as "region which lies opposite the hollow needle".

In conjunction with the application, a device, by means of which a detaching force can be applied before a piercing operation, is called a "detaching device". The detaching device is, for example, a device, by means of which a section of the foil bag can be gripped mechanically, by way of the application of suction force, for example means of vacuum or flow, electrostatically, by means of adhesion forces, for example by means of an adhesive bond, or in some other way and can be moved relative to the sterilely packaged object. In other embodiments, a detaching force is generated by means of pressure differences, it being possible for the pressure difference to be applied locally in a manner which is restricted to a section of the foil bag, for example by means of a sealing collar, or to act on the entire foil bag.

The detaching action generates a space between the foil bag and the packaged sterile object, with the result that a contact of the hollow needle with the sterile object is avoided during the piercing operation. In addition, it is avoided that a multiple-layer section lies opposite the needle unit on account of folded-in or folded-away parts of the foil bag or on account of folds in the foil bag, which section otherwise could be perforated during the piercing operation, with the result that injected gas escapes via the perforated section and an injection of the gas is not reliably possible.

The injected gas is air in one embodiment. In other embodiments, an inert gas, for example nitrogen, is injected. Depending on applications, other toxic or non-toxic gases are also conceivable.

In one embodiment, the detaching device comprises a vacuum chamber, into which the foil bag with the object packaged therein can be introduced, it being possible for a negative pressure or vacuum to be generated in the vacuum chamber, with the result that the foil bag is detached at least in regions from the sterile object packaged therein. In one embodiment, a pump or a vacuum ejector is provided to generate a vacuum in the vacuum chamber. In case of a vacuum chamber, depending on the application, the needle unit can be provided at a suitable point in the vacuum chamber. For reproducible positioning of a piercing point in the foil bag, it is provided in one embodiment that the foil bag is introduced into the vacuum chamber with a defined orientation.

As an alternative or in addition, the detaching device in one embodiment comprises a sealing collar with a circumferential rim for bearing against the foil bag, the sealing collar being configured to apply a detaching force to the foil bag. In one embodiment, the sealing collar is mounted movably relative to the object packaged in the foil bag, it being possible for the sealing collar to be placed onto the foil bag and to be moved away from the object packaged in the foil bag with the application of a detaching force, with the result that the foil bag is detached from the sterile object packaged therein at least in a region which lies within and adjacent to the sealing collar. In other embodiments, the sealing collar is arranged spaced apart from the foil bag, the foil bag being forced in the direction of the sealing collar with application of a detaching force, with the result that the foil bag is detached from the sterile object packaged therein at least in a region which lies within and adjacent to the sealing collar. Here, in one embodiment, the application of the detaching force for moving the foil bag with respect to the sealing collar takes place by way of a generated pressure difference between the interior and the exterior of the foil bag in the vacuum chamber.

It is provided here in one embodiment that the sealing collar surrounds the hollow needle at least in sections, it being possible for the hollow needle and the sealing collar to be displaced relative to one another between a rest position and a use position, it being possible for the foil bag to be pierced by way of a relative movement out of the rest position into the use position. For high process reliability, it is provided in one embodiment that the hollow needle is mounted movably, a movement of the hollow needle out of the rest position into the use position taking place only when the foil bag has been detached at least in regions. This ensures that the foil bag is held under stress by means of the sealing collar reliably and preferably with the application of the detaching force, with the result that a piercing operation without fraying or fibre formation on the foil bag is ensured. In one embodiment, the hollow needle and the sealing collar are arranged coaxially or in parallel, a relative movement between the hollow needle and the sealing collar taking place in the longitudinal direction of the hollow needle.

It is provided in one embodiment that a needle tip of the hollow needle is arranged in the interior space of the sealing collar at least in the rest position, and the rim of the sealing collar protrudes beyond the needle tip, and it being possible for the hollow needle and the sealing collar to be displaced relative to one another out of the rest position into the use position in order to pierce the foil bag.

In one embodiment, a pressure lowering device is provided on the sealing collar, which pressure lowering device is configured to lower a pressure in an interior space of the sealing collar in such a way that a section of the foil bag bulges in the direction of the sealing collar and/or is forced into contact with the sealing collar.

Here, the sealing collar bears against the foil bag with a seal which is sufficient that, in the case of a pressure drop in the sealing collar, the foil bag bears with a sufficient stress against the sealing collar for reliable piercing by means of the hollow needle. In one embodiment, the sealing collar bears against the foil bag in an air-tight manner. In the context of the application, "air-tight" also denotes a bearing against the foil bag with a tolerable leakage flow. In one embodiment, the sealing collar is mounted movably, it being possible for the sealing collar to bear against the foil bag with a sufficient seal for a pressure drop in the sealing collar, with the result that, in the case of a movement of the sealing collar away from the object packaged in the foil bag, a section of the foil bag is detached from the sterile object packaged therein at least in a region which lies within and adjacent to the sealing collar. In one embodiment, lowering of the pressure takes place by means of a mechanically or electromechanically operated piston pump which is arranged on the sealing collar. In other embodiments, the sealing collar has a vacuum port for lowering the pressure in the sealing collar. Via the vacuum port, the sealing collar can be connected to a vacuum generator such as, for example, a pump or a vacuum ejector.

The pressure lowering device on the sealing collar can be provided as an alternative or in addition to the vacuum chamber.

In another embodiment, as an alternative to the pressure lowering device, a suction bell which surrounds the sealing collar is provided, it being possible for a gas, in particular compressed air or an inert gas which is fed in under pressure, to be fed in via a gap which is formed between the suction bell and the sealing collar, with the result that a section of the foil bag is forced in the direction of the sealing collar. The gap is designed suitably such that the gas can be fed in in such a way that a suction effect is generated, on account of which a detaching force acts on the foil bag. The detaching force forces a section of the foil bag in the direction of the sealing collar. In the next step, the sealing collar can be moved with the foil bag for further detaching of the foil bag and/or the hollow needle can penetrate the detached region of the foil bag. Here, the same gas which is also introduced into the foil bag after a piercing operation can be used to generate a suction effect in the suction bell. A further medium can be dispensed with in this case.

In one embodiment, the sealing collar is arranged on a wall element with a contact surface to the foil bag, in particular on a base, the rim of the sealing collar being arranged spaced apart from the contact surface. In this case, at least one region of the foil bag is forced in the direction of the sealing collar by means of the detaching force which is applied by way of the detaching device, in particular the sealing collar and/or the vacuum chamber. In one embodiment, the needle tip of the hollow needle is shielded by the sealing collar at least in the rest position. As a result, undesired contact of the hollow needle with the foil bag is reliably avoided. In one embodiment, the sealing collar is mounted movably and can be displaced out of a use position, in which the rim of the sealing collar is arranged spaced apart from the contact surface, in the direction of the contact surface, in order to "fetch" a section of the foil bag and to transfer it with the sealing collar for piercing into the use position.

In one embodiment, a transport device is provided, the needle unit being arranged on the transport device in order to transport the foil bag with injection of gas to a subsequent device. The transport device is, for example, a carriage or moving table, on which the foil bag with the object arranged therein is deposited.

In accordance with a second aspect, a method for straightening a foil bag with a sterile object packaged therein is provided, wherein the foil bag is pierced by means of a hollow needle and gas is injected into the foil bag, and wherein a detaching force is applied to the foil bag before piercing into the foil bag, with the result that the foil bag is detached from the sterile object packaged therein at least in a region which lies opposite the hollow needle. By detaching the foil bag from the sterile object at least in regions, a clearance is formed between the foil bag and the sterile object packaged therein, into which clearance the hollow needle can penetrate during the piercing operation, without the hollow needle coming into contact with the sterile object.

In one embodiment, in order to generate the detaching force, the foil bag with the object packaged therein is introduced into a vacuum chamber, wherein a negative pressure or vacuum is generated in the vacuum chamber, with the result that the foil bag is detached at least in regions from the sterile object packaged therein.

As an alternative or in addition, in one embodiment, for a piercing operation, a sealing collar with a circumferential rim is brought into contact with the foil bag. A section of the foil bag can be held or fixed in a defined position for a piercing operation by means of the sealing collar.

It is provided here in one embodiment that the sealing collar surrounds the hollow needle at least in sections, the hollow needle and the sealing collar being displaced relative to one another between a rest position and a use position. Depending on the application, the sealing collar and/or the hollow needle are/is mounted movably, the hollow needle and/or the sealing collar being displaced out of the rest position into the use position in order to pierce the foil bag. In embodiments, the hollow needle and the sealing collar are arranged coaxially or in parallel, the hollow needle and the sealing collar being moved relative to one another in the longitudinal direction of the hollow needle.

In one embodiment, a needle tip of the hollow needle is arranged in the interior space of the sealing collar at least in the rest position, the rim of the sealing collar protruding beyond the needle tip, and the hollow needle and the sealing collar are displaced relative to one another out of the rest position into the use position in order to pierce the foil bag.

In one embodiment, a pressure in an interior space of the sealing collar is lowered in such a way that a section of the foil bag is forced into contact with the sealing collar. It is provided here in one embodiment that the sealing collar is brought into contact with the foil bag before lowering of the pressure, the sealing collar being moved away from the object with a bearing region of the foil bag in order to form a clearance between the foil bag and the object packaged therein. It is provided in other embodiments that the sealing collar is arranged in a stationary manner spaced apart from the foil bag, a detaching force being applied to a section of the foil bag by way of lowering of the pressure, which detaching force forces the foil bag in the direction of the sealing collar into contact with the sealing collar.

As an alternative, in one embodiment, a suction bell which surrounds the sealing collar is provided, a gas, in particular compressed air or an inert gas which is fed in under pressure, being fed in via a gap which is formed between the suction bell and the sealing collar, with the result that a section of the foil bag is forced in the direction of the sealing collar.

It is provided in one embodiment that the foil bag is transported in the direction of a subsequent device while gas is injected by means of the needle unit. Here, straightening of the foil bag can be maintained by way of an injection of gas during the transport.

BRIEF DESCRIPTION OF THE DRAWINGS

Further features, details and merits of the invention result from the claims and the abstract, the wording of both of which is incorporated into the description by reference, and from the following description of exemplary embodiments of the invention, and from the drawings, in which:

DETAILED DESCRIPTION OF THE EXEMPLARY EMBODIMENTS

Figure 1:
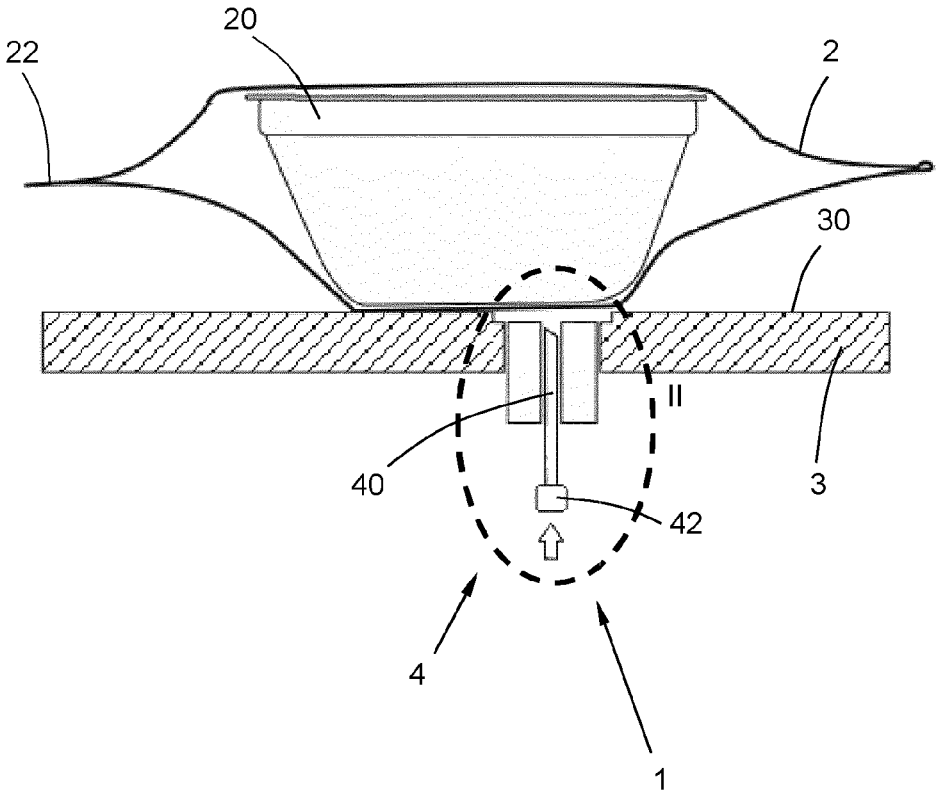
FIG. 1 shows a foil bag with a sterile object packaged therein, and an apparatus for straightening the foil bag.

FIG. 1 schematically shows a foil bag 2 with a sterile object 20 packaged therein, the foil bag 2 lying on a base 3 with a contact surface 30. An apparatus 1 for straightening the foil bag 2 is arranged on the base 3, which apparatus 1 comprises a needle unit 4 with a hollow needle 40 and a gas port 42. A gas, for example compressed air or an inert gas, such as nitrogen, can be injected into the foil bag 2 by means of the needle unit 4, with the result that the foil bag 2 is straightened or maintains already existing straightening. Here, straightening of the foil bag 2 denotes a transfer into a state, in which tabs 22 or similar parts of the foil bag 2 do not bear tightly against the object 20, but rather protrude laterally (as shown schematically in FIG. 1), with the result that the tabs 22 or similar parts of the foil bag 2 can be gripped by means of a gripping or transport device (not shown in FIG. 1).

Figure 2:
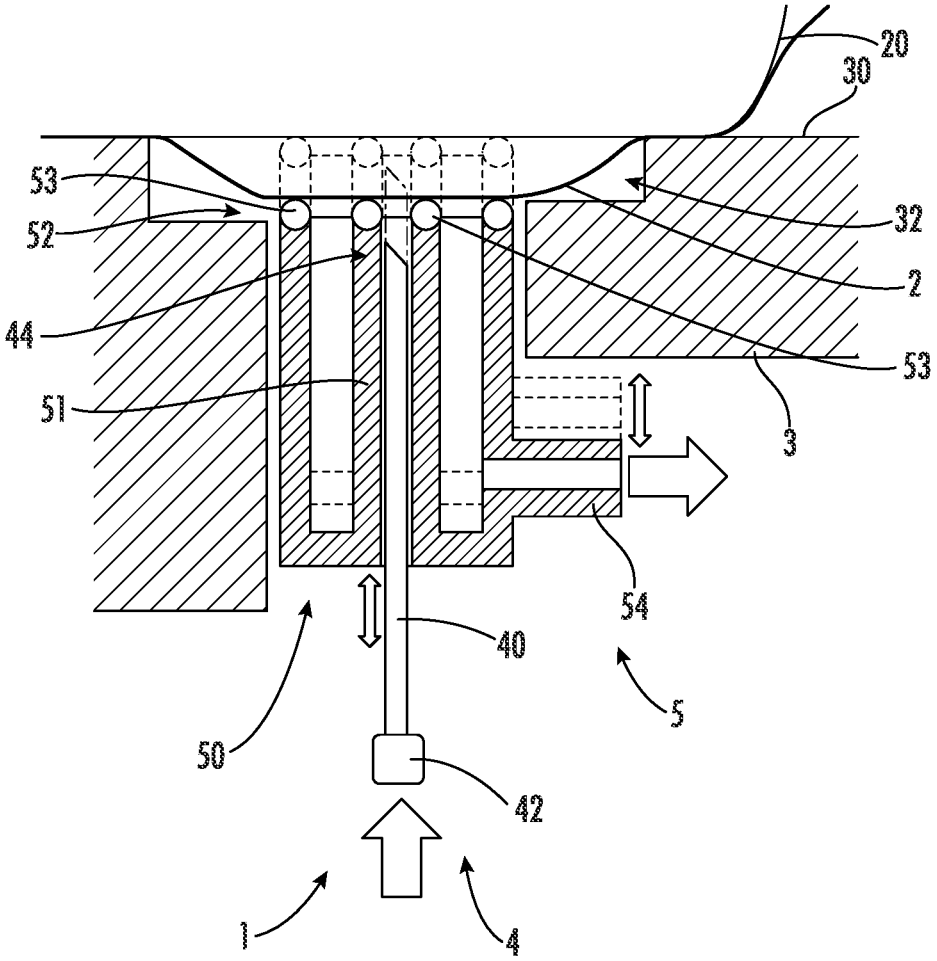
FIG. 2 shows a first exemplary embodiment of an apparatus for straightening a foil bag.

FIG. 2 schematically shows one exemplary embodiment of an apparatus 1 for straightening a foil bag 2 comprising a needle unit 4 with a hollow needle 40 for piercing into the foil bag 2 and a gas port 42 for injecting gas via the hollow needle 40 into the foil bag 2.

A consequence of contact of the hollow needle 40 with the object 20 can be that the object 20 is damaged, a sealing foil which is provided on the object 20 is unintentionally perforated and/or contaminations or downtimes as a result of damage of the hollow needle 40 occur.

In order to ensure that the foil bag 2 is penetrated reliably without the hollow needle 40 making contact with the object 20, the apparatus 1 comprises, furthermore, a detaching device 5 which is configured to apply a detaching force to the foil bag 2, with the result that the foil bag 2 is detached from the sterile object 20 packaged therein at least in a region which lies opposite the hollow needle 40.

In the exemplary embodiment according to FIG. 2, the detaching device 5 comprises a sealing collar 50 which is arranged coaxially with respect to the hollow needle 40 and surrounds the hollow needle 40 at least in sections, with a circumferential rim 52 for contact with the foil bag 2. For sufficiently tight contact with the foil bag 2, a sealing element which is shown schematically as an O-ring 53 is provided on the rim 52 in the exemplary embodiment shown in FIG. 2.

The sealing collar 50 has a vacuum port 54, by means of which a pressure in the sealing collar 50 can be lowered, with the result that a section of the foil bag 2 is forced into contact with the sealing collar 50 as shown schematically in FIG. 2. Instead of a vacuum port 54, alternative pressure lowering devices are provided in other embodiments, which pressure lowering devices are suitable for lowering a pressure in an interior space of the sealing collar, for example by means of a pneumatically, hydraulically and/or electromechanically adjustable piston.

In the exemplary embodiment shown in FIG. 2, the sealing collar 50 and the hollow needle 40 are both mounted adjustably (as shown schematically by way of double arrows). Here, the sealing collar 50 can first of all be placed onto the foil bag 2 on a lower side of the object 20 (as shown schematically using dashed lines).

The pressure is lowered in the sealing collar 50, with the result that the foil bag 2 is forced into contact with the sealing collar 50 and, in the case of a movement of the sealing collar 50, a section of the foil bag 2 is moved with the sealing collar 50 into the position which is shown in FIG. 2, a detaching force being applied to the foil bag 2, with the result that the foil bag 2 is detached from the object 20 at least in regions. In order to ensure sufficient detaching of the foil bag 2, the base 3 in the exemplary embodiment shown has a recess 32, into which a section of the foil bag 2 bulges.

As soon as the foil bag 2 is detached from the object 20 at least in regions, the foil bag 2 can be pierced reliably by means of the hollow needle 40. Here, contact between the hollow needle 40 and the sterile object 20 is avoided.

For reliable piercing, the hollow needle 40 can be displaced in the exemplary embodiment shown in the longitudinal direction of the hollow needle 40 relative to the sealing collar 50 between a rest position which is shown in FIG. 2 and a use position which is shown using dashed lines in FIG. 2.

In the embodiment shown, in the rest position, a needle tip 44 of the hollow needle 40 is arranged in the interior space of the sealing collar 50 and the rim 52 of the sealing collar 50 protrudes beyond the needle tip 44, wherein the hollow needle 40 can be displaced relative to the sealing collar 50 out of the rest position which is shown in FIG. 2 into the use position in order to pierce the foil bag 2.

After the fetching of the foil bag 2, in the state which is shown in FIG. 2, the sealing collar 50 is arranged on the base 3 in such a way that the rim 52 of the sealing collar 50 is arranged spaced apart from the contact surface 30. In the use position, the needle tip 44 is likewise positioned spaced apart from the contact surface 30. As a result, contact between the needle tip 44 and the object 20 is avoided reliably.

In the exemplary embodiment shown in FIG. 2, the sealing collar 50 has a central guide channel 51 for the hollow needle 40. Here, a length of the guide channel 51 corresponds to the height of the sealing collar 50, with the result that the section of the foil bag 2 also bears against a free end of the guide channel 51. For sealing contact with the foil bag 2, a sealing element which is shown schematically as an O-ring 53 is likewise provided at the free end of the guide channel 51. The guide channel 51 and an outer wall of the sealing collar 50 form an annular channel which surrounds the hollow needle 40 and via which the foil bag 2 is attracted by suction and is forced with a sufficiently stressed state onto the sealing collar 50 for reliable piercing of the foil bag 2.

In an alternative exemplary embodiment which is similar to FIG. 2, the sealing collar 50 is arranged in a stationary manner in the base 3 spaced apart from the contact surface 30, and only the hollow needle 40 can be displaced between a rest position and a use position. Here, a detaching force is applied by means of the sealing collar 50 which is arranged spaced apart from the contact surface 30, with the result that a section of the foil bag 2 bulges in the direction of the sealing collar 50 and is forced onto the latter. Subsequently, the hollow needle 40 is moved in order to pierce the foil bag 2.

Figure 3:
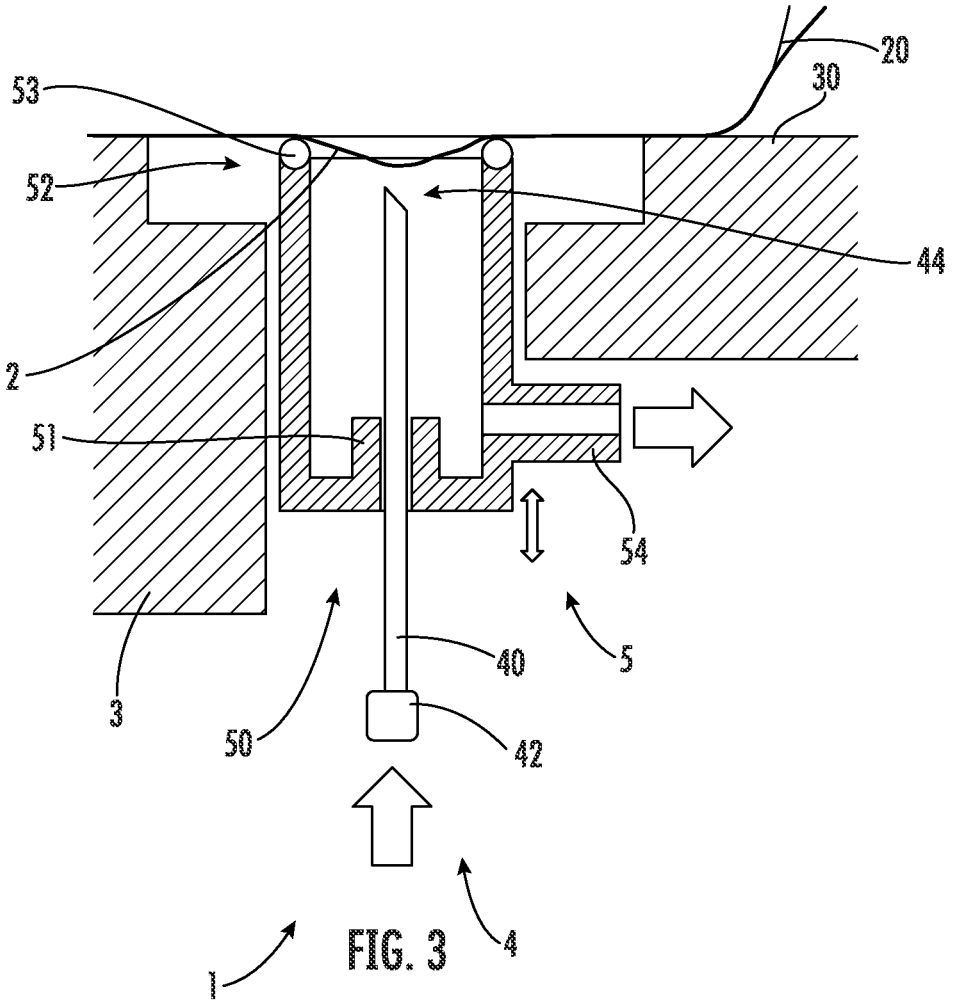
FIG. 3 shows a second exemplary embodiment of an apparatus for straightening a foil bag.

FIG. 3 shows a second exemplary embodiment of an apparatus 1 for straightening a foil bag 2 with a needle unit 4 and a detaching device 5 similar to the embodiment according to FIG. 2. Here, the same reference numerals are used for identical or similar components or assemblies.

In the embodiment of FIG. 3, the sealing collar 50 is likewise mounted movably and is placed directly onto the foil bag 2 in the rest position which is shown in FIG. 3. By means of a pressure lowering device, a pressure in the interior space of the sealing collar 50 which bears against the foil bag 2 is lowered in such a way that a section of the foil bag 2 is forced onto the sealing collar 50 and is detached from the object 20 by way of the movement of the sealing collar 50 into the use position.

In one embodiment, the hollow needle 40 of the needle unit 4 is mounted in the base 3 in a stationary manner, piercing of the foil bag 2 taking place on account of a movement of the sealing collar 50. As an alternative, the hollow needle 40 can likewise be displaced, a detaching force first of all being applied to the foil bag 2 by way of movement of the sealing collar 50 out of the rest position, and, subsequently or in a temporally overlapping manner, the hollow needle 40 being moved relative to the already detached foil bag 2 in order to pierce the foil bag 2.

In contrast to the embodiment according to FIG. 2, a shorter guide channel 51 is provided, with the result that the foil bag 2 bulges into the interior space in the case of a pressure drop in the interior of the sealing collar 50. In other embodiments, a length of the guide channel 51 is equal to the length of the sealing collar 50, the hollow needle 40 being moved relative to the already detached foil bag 2 in order to pierce the foil bag 2 subsequent to or overlapping temporally with a movement of the sealing collar 50.

Figure 4:
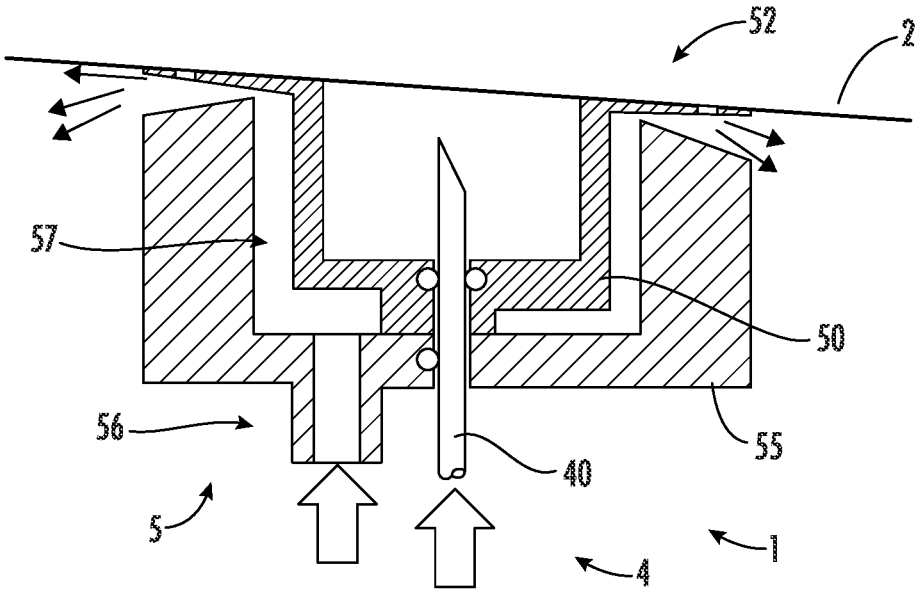
FIG. 4 shows a third exemplary embodiment of an apparatus for straightening a foil bag.

FIG. 4 shows a third exemplary embodiment of an apparatus 1 for straightening a foil bag 2 comprising a needle unit 4 with a hollow needle 40 and a gas port 42 (not shown in FIG. 4). The apparatus 1 according to FIG. 4 likewise comprises a detaching device 5 which is configured to apply a detaching force to the foil bag 2, with the result that the foil bag 2 is detached from the sterile object (not shown in FIG. 4) packaged therein at least in a region which lies opposite the hollow needle 40.

The detaching device 5 according to FIG. 4 comprises a sealing collar 50 and a suction bell 55 which surrounds the sealing collar 50 and has a gas port 56 for feeding in gas. The gas which is fed in is preferably the same gas as the gas which is injected via the hollow needle 40 into the foil bag 2.

A gap 57 is provided between the sealing collar 50 and the suction bell 55, it being possible for the gas to be fed in via the gap 57 in such a way that a suction effect is generated, with the result that a section of the foil bag 2 is forced in the direction of the sealing collar 50. The detaching device 5 according to FIG. 4 utilizes the Bernoulli principle to generate a vacuum which causes the section of the foil bag being forced in the direction of the sealing collar.

Figure 5:
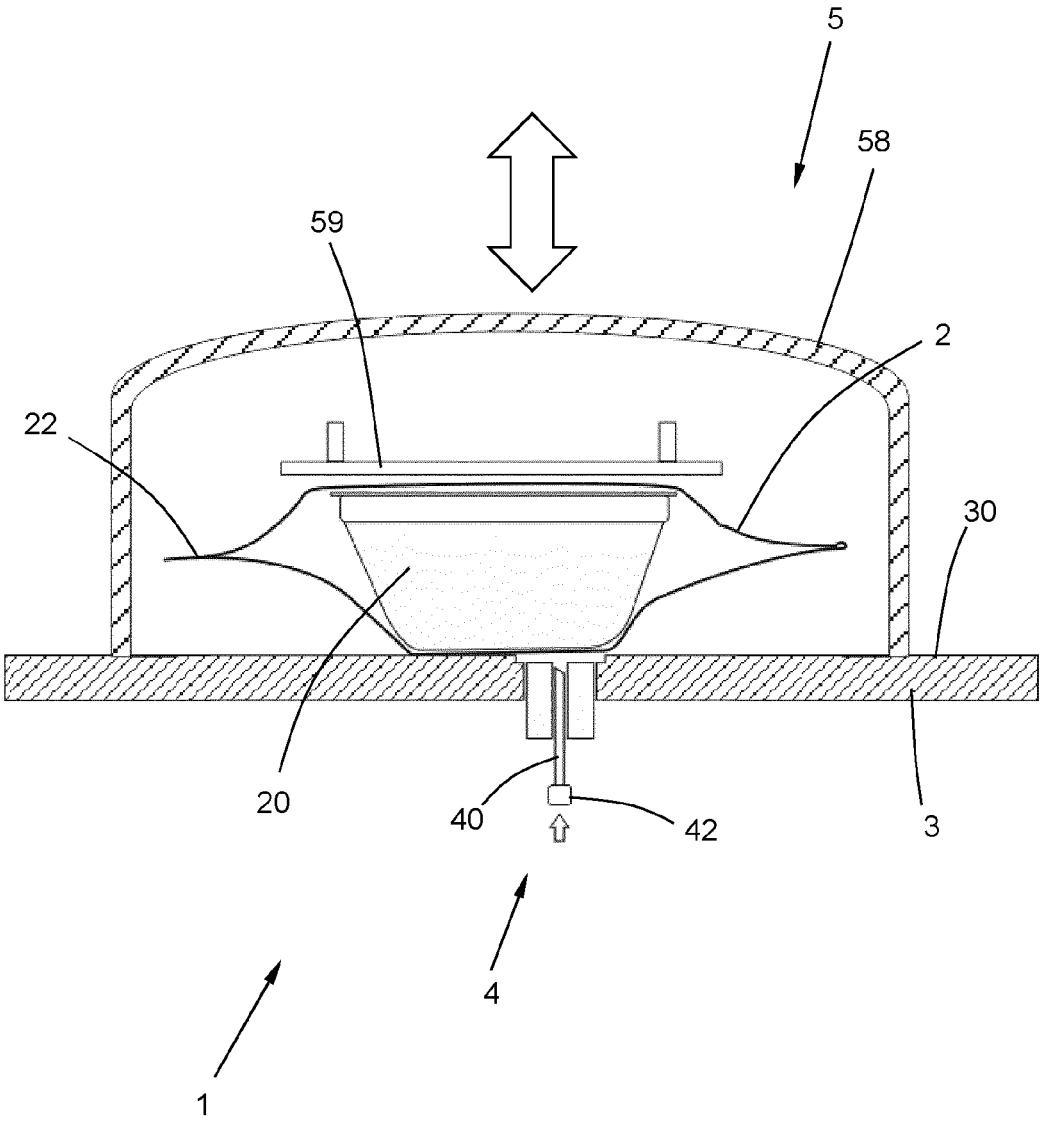
FIG. 5 shows a foil bag with a sterile object packaged therein, and a fourth exemplary embodiment of an apparatus for straightening the foil bag.

FIG. 5 shows a fourth exemplary embodiment of an apparatus 1 for straightening a foil bag 2 in a similar manner to FIG. 1. Here, uniform reference numerals are used for identical or similar components. In contrast to the exemplary embodiments according to FIGS. 2 to 4, an application of a detaching force does not take place in a locally limited manner by means of a sealing collar 50. Rather, the detaching device 5 according to FIG. 5 has a vacuum chamber 58 which receives the foil bag 2. As shown schematically by way of a double arrow, the vacuum chamber 58 can be opened and closed in order to introduce or remove the foil bag 2. As a result of a pressure drop in the vacuum chamber 58, the foil bag 2 is straightened and is detached from the object 20 in such a way that the foil bag 2 can be pierced by means of the hollow needle 40.

In order to prevent rising of the foil bag 2 in the case of a pressure drop, the detaching device 5 which is shown has, furthermore, a hold-down device 59 which is arranged above the foil bag 2 at a slight spacing from the latter.

Figure 6:
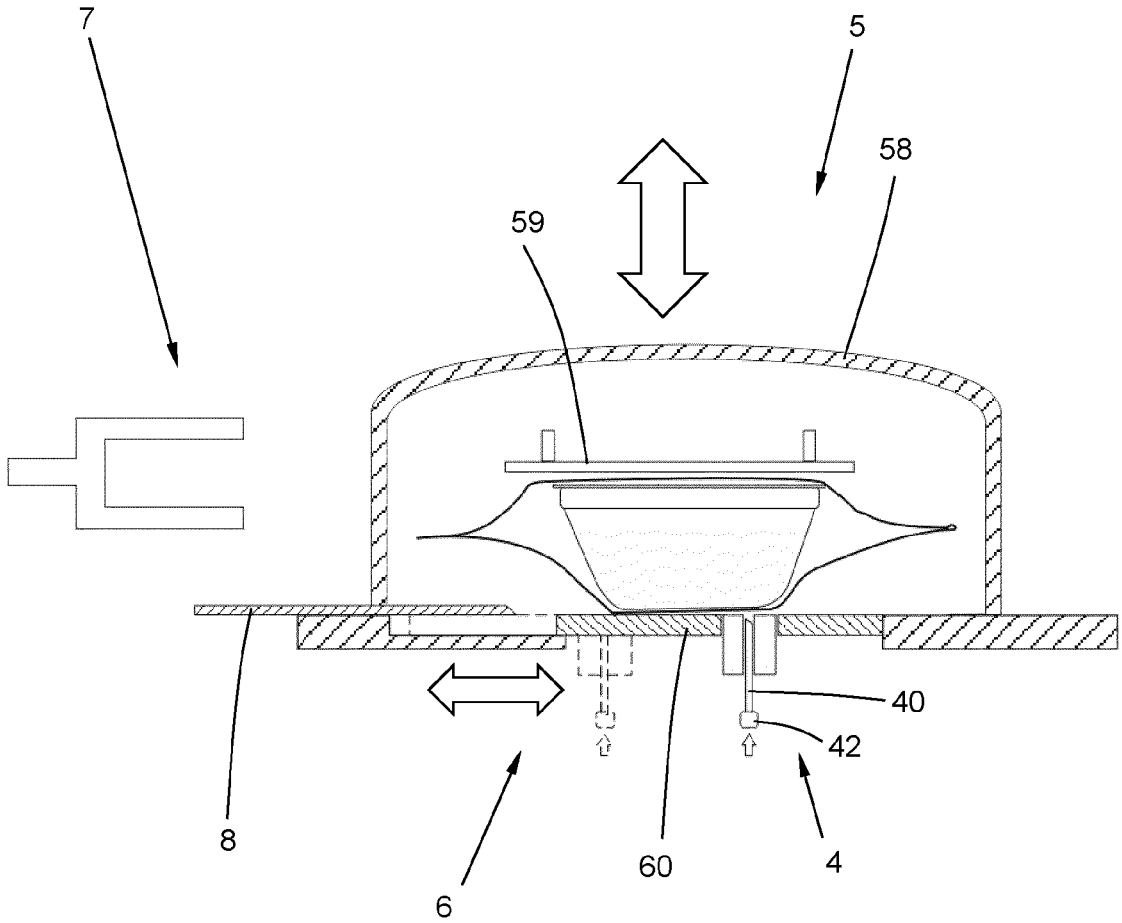
FIG. 6 shows a foil bag with a sterile object packaged therein, and a fifth exemplary embodiment of an apparatus for straightening the foil bag.

FIG. 6 shows a further exemplary embodiment of an apparatus 1 for straightening a foil bag 2 in a similar manner to FIG. 5, comprising a detaching device 5 with a vacuum chamber 58. Again, uniform reference numerals are used for identical or similar components.

The apparatus 1 which is shown in FIG. 6 comprises, furthermore, a transport apparatus 6 with a moving table 60. As is illustrated schematically by way of a double arrow and a dashed illustration, the moving table 60 can be displaced for a movement of the foil bag 2 out of or into a region of the vacuum chamber 58. In the exemplary embodiment shown, a transfer device which is schematically shown as a gripping device 7 is provided outside a region of the vacuum chamber 58. The foil bag 2 can be transported by means of the gripping device 7 to a subsequent processing device, at which, for example, the foil bag 2 can be removed from the packaged sterile object 20. A ramp 8 is provided for reliable transfer to the gripping device 7 in the exemplary embodiment shown. In other embodiments, the ramp 8 is dispensed with.

In other embodiments, transport takes place directly by means of the transport apparatus 6 without an additional gripping device.

In the exemplary embodiment shown in FIG. 6, the needle unit 4 is arranged on the transport device 6, with the result that the foil bag 2 can be transported with injection of gas.

The drawings which are shown are merely diagrammatic. In particular, bearing elements, sealing elements or the like are not shown. These can be selected suitably by a person skilled in the art depending on the application.

The exemplary embodiments which are shown are merely by way of example, and numerous modifications are conceivable in order to obtain further embodiments. In particular, features which are described or shown as part of one exemplary embodiment can likewise be used in another exemplary embodiment, in order to obtain a further embodiment of the invention.

What is claimed is:

1. An apparatus for straightening a foil bag with a sterile object packaged therein, the apparatus comprising a needle unit with a hollow needle for piercing the foil bag and with a gas port for injecting gas via the hollow needle into the foil bag, wherein a detaching device is provided which is configured to apply a detaching force to the foil bag before a piercing operation, with the result that the foil bag is detached from the sterile object packaged therein at least in a region which lies opposite the hollow needle.

2. The apparatus according to claim 1, wherein the detaching device comprises a vacuum chamber, into which the foil bag with the object packaged therein can be introduced, it being possible for a negative pressure or vacuum to be generated in the vacuum chamber, with the result that the foil bag is detached at least in regions from the sterile object packaged therein.

3. The apparatus according to claim 1, wherein the detaching device has a sealing collar with a circumferential rim for bearing against the foil bag, the sealing collar being configured to apply a detaching force to the foil bag.

4. The apparatus according to claim 3, wherein the sealing collar surrounds the hollow needle at least in sections, it being possible for the hollow needle and the sealing collar to be displaced relative to one another between a rest position and a use position, wherein in particular a needle tip of the hollow needle is arranged in the interior space of the sealing collar at least in the rest position, and the rim of the sealing collar protrudes beyond the needle tip, and it being possible for the hollow needle and the sealing collar to be displaced relative to one another out of the rest position into the use position in order to pierce the foil bag.

5. The apparatus according to claim 3, wherein a pressure lowering device is provided on the sealing collar, which pressure lowering device is configured to lower a pressure in an interior space of the sealing collar in such a way that a section of the foil bag bulges in the direction of the sealing collar and/or a section of the foil bag is forced into contact with the sealing collar, wherein in particular the pressure lowering device has a vacuum port for lowering the pressure in the sealing collar.

6. The apparatus according to claim 3, hat wherein a suction bell which surrounds the sealing collar is provided, it being possible for a gas, in particular compressed air or an inert gas which is fed in under pressure, to be fed in via a gap which is formed between the suction bell and the sealing collar, with the result that a section of the foil bag is forced in the direction of the sealing collar.

7. The apparatus according to claim 3, wherein the sealing collar is arranged on a wall element with a contact surface to the foil bag, in particular on a base, the rim of the sealing collar being arranged spaced apart from the contact surface.

8. The apparatus according to claim 1, wherein a transport device is provided, the needle unit being arranged on the transport device in order to transport the foil bag with injection of gas.

9. A method for straightening a foil bag with a sterile object packaged therein, wherein the foil bag is pierced by means of a hollow needle, and wherein gas is injected into the foil bag, wherein a detaching force is applied to the foil bag before piercing into the foil bag, with the result that the foil bag is detached from the sterile object packaged therein at least in a region which lies opposite the hollow needle.

10. The method according to claim 9, wherein the foil bag with the object packaged therein is introduced into a vacuum chamber, wherein a negative pressure or vacuum is generated in the vacuum chamber, with the result that the foil bag is detached at least in regions from the sterile object packaged therein.

11. The method according to claim 9, wherein, for a piercing operation, a sealing collar with a circumferential rim is brought into contact with the foil bag.

12. The method according to claim 11, wherein the sealing collar surrounds the hollow needle at least in sections, the hollow needle and the sealing collar being displaced relative to one another between a rest position and a use position, wherein in particular a needle tip of the hollow needle is arranged in the interior space of the sealing collar at least in the rest position, and the rim of the sealing collar protrudes beyond the needle tip, and the hollow needle and the sealing collar are displaced relative to one another out of the rest position into the use position in order to pierce the foil bag.

13. The method according to claim 11, wherein a pressure in an interior space of the sealing collar is lowered in such a way that a section of the foil bag is forced into contact with the sealing collar.

14. The method according to claim 11, wherein a suction bell which surrounds the sealing collar is provided, wherein a gas, in particular compressed air or an inert gas which is fed in under pressure, is fed via a gap which is formed between the suction bell and the sealing collar, with the result that a section of the foil bag is forced in the direction of the sealing collar.

15. The method according to claim 9, wherein the foil bag is transported in the direction of a subsequent device while gas is injected into the foil bag by means of the needle unit.

* * * * *